US008472837B2

(12) United States Patent
Ishii et al.

(10) Patent No.: US 8,472,837 B2
(45) Date of Patent: Jun. 25, 2013

(54) PHOTOSENSITIVE MEMBER CARTRIDGE FOR HOLDING PHOTOSENSITIVE MEMBER AND MOUNTING DEVELOPING CARTRIDGES

(75) Inventors: Hirotaka Ishii, Suntou-gun (JP); Shinji Kawamura, Suntou-gun (JP); Makoto Nishigaki, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 12/843,267

(22) Filed: Jul. 26, 2010

(65) Prior Publication Data

US 2011/0026968 A1 Feb. 3, 2011

(30) Foreign Application Priority Data

Jul. 30, 2009 (JP) ..... 2009-177667
Jun. 29, 2010 (JP) ..... 2010-147533

(51) Int. Cl.
*G03G 15/00* (2006.01)

(52) U.S. Cl.
USPC ..... 399/111

(58) Field of Classification Search
USPC ..... 399/111, 116, 113
See application file for complete search history.

(56) References Cited

U.S. PATENT DOCUMENTS

| | | | | |
|---|---|---|---|---|
| 5,428,426 | A | 6/1995 | Inomata et al. | |
| 6,647,227 | B2 | 11/2003 | Yokoi et al. | |
| 2004/0005168 | A1 * | 1/2004 | Baek | 399/116 |
| 2005/0002689 | A1 * | 1/2005 | Jeong et al. | 399/111 |
| 2007/0280730 | A1 * | 12/2007 | Okabe et al. | 399/111 |
| 2008/0170881 | A1 * | 7/2008 | Choi et al. | 399/113 |
| 2010/0221039 | A1 * | 9/2010 | Kawai et al. | 399/121 |

* cited by examiner

*Primary Examiner* — Quana M Grainger
(74) *Attorney, Agent, or Firm* — Fitzpatrick, Cella, Harper & Scinto

(57) ABSTRACT

A color electrophotographic image forming apparatus includes: a drum cartridge, detachably mountable to the apparatus main assembly, for holding a drum; developing cartridges, each including a developing roller for developing an electrostatic latent image formed on the drum, demountable from the cartridge; a main assembly guide for guiding the cartridge from the main assembly; a drum cartridge guide for guiding the developing devices independently demountably from the cartridge; and a drum cartridge preventor for preventing movement of the cartridge. When the developing cartridge is demounted while drum cartridge is mounted in the main assembly, the preventor is movable between a first position preventing the cartridge from moving in a demounting direction and a second position permitting such movement. The apparatus includes a grip for facilitating demounting of the drum cartridge by facilitating a change of the preventor's position from the first position to the second position.

17 Claims, 11 Drawing Sheets

(a)

(b)

(a)

(b)

PHOTOSENSITIVE MEMBER CARTRIDGE FOR HOLDING PHOTOSENSITIVE MEMBER AND MOUNTING DEVELOPING CARTRIDGES

FIELD OF THE INVENTION AND RELATED ART

The present invention relates to a color electrophotographic image forming apparatus in which a plurality of cartridges is detachably mountable to an apparatus main assembly and a color image is formed on a recording material (medium).

The color electrophotographic image forming apparatus forms the color image on the recording material by using an electrophotographic image forming process. Examples of the color electrophotographic image forming apparatus may include a color electrophotographic copying machine, a color electrophotographic printer (such as a color laser beam printer or a color LED printer), a color facsimile machine, a color word processor, and the like. Further, the recording material is a medium on which the image is to be formed by the electrophotographic image forming apparatus and, e.g., includes paper, an OHP sheet, and the like.

Further, the cartridge may, e.g., include a process cartridge or a developing cartridge. The cartridge is provided detachably mountable to the apparatus main assembly of the electrophotographic image forming apparatus. The cartridge contributes to an image forming process, for forming the image on the recording material, in a state in which the cartridge is mounted in the apparatus main assembly. The process cartridge is prepared by integrally assembling process means and an electrophotographic photosensitive drum (hereinafter referred to as a photosensitive member) into a cartridge. The process means act on the photosensitive member. For example, the process cartridge is prepared by integrally assembling the photosensitive member (the electrophotographic photosensitive drum) and, as the process means, at least one of a charging means, a developing means, and a cleaning means into a cartridge and is detachably mountable to the apparatus main assembly. The process cartridge integrally including the mount and the developing means is referred to as that of a so-called integral type. Further, the process cartridge integrally including the photosensitive member and the process means other than the developing means is referred to as that of a so-called separation type. That is, the separation type process cartridge is used as a drum cartridge for forming an image by being paired with a developing unit (developing cartridge) prepared separately from the process cartridge by including the developing means. The process cartridge can be mounted in and demounted from the apparatus main assembly by a user himself (herself). For that reason, maintenance of the apparatus main assembly can be performed easily.

The developing cartridge includes a developing roller and a developer (toner) used for developing an electrostatic latent image formed on the photosensitive member by the developing roller and is detachably mounted in the apparatus main assembly. In the case of the developing cartridge, the photosensitive member is mounted in the apparatus main assembly or on a cartridge supporting member. Alternatively, the photosensitive member is provided in the so-called separation type process cartridge (drum cartridge). In this case, as described above, the process cartridge does not include the developing means. The developing cartridge can also be mounted and demounted from the apparatus main assembly by the user alone. For that reason, the maintenance of the apparatus main assembly can be performed easily.

In the present invention, the cartridge includes the above-described so-called integral type and separation type process cartridges. Further, the cartridge includes a pair of the so-called separation type process cartridge and the developing cartridge which are used in combination. Further, the cartridge also includes the case where the photosensitive member is mounted in the apparatus main assembly or on the cartridge supporting member and the developing cartridge is used openably and detachably mountable with respect to the photosensitive member.

U.S. Pat. No. 5,428,426 discloses an image forming apparatus capable of forming a color image. The image forming apparatus has a constitution in which an intermediary transfer member is driven by an apparatus main assembly-side driving source and a photosensitive drum is rotationally driven via the intermediary transfer member.

U.S. Pat. No. 6,647,227 discloses an image forming apparatus having a constitution in which a process means accommodating member in which a plurality of developing cartridges and a photosensitive belt mechanism portion are detachably mounted can be pulled out from an intermediary transfer member accommodating member.

SUMMARY OF THE INVENTION

The present invention has further developed the above-described conventional constitutions.

A principal object of the present invention is to provide a color electrophotographic image forming apparatus which enables easy mounting and demounting of a mount cartridge and which is easy to use by a user.

According to an aspect of the present invention, there is provided a color electrophotographic image forming apparatus comprising:

a photosensitive member cartridge, detachably mountable to a main assembly of the color electrophotographic image forming apparatus, for holding a photosensitive member;

a plurality of developing cartridges each including a developing roller for developing an electrostatic latent image formed on the photosensitive member into a developer image, the plurality of developing cartridges being demountable from the photosensitive member cartridge;

a main assembly-side guide portion, provided in the main assembly, for guiding the photosensitive member cartridge demountably from the main assembly;

a photosensitive member cartridge-side guide portion, provided in the photosensitive member cartridge, for guiding the plurality of developing devices independently demountably from the photosensitive member cartridge;

a preventing portion, provided in the photosensitive member cartridge, for preventing movement of the photosensitive member cartridge, wherein when an operation for demounting the developing cartridge is performed in a state in which the photosensitive member cartridge is mounted in the main assembly, the preventing portion is movable between a first position in which the photosensitive member cartridge is prevented from moving in a demounting direction in which the photosensitive member cartridge is to be demounted and a second position in which the photosensitive member cartridge is permitted to move in the demounting direction; and a grip portion for permitting demounting of the photosensitive member cartridge, the grip portion being operable so as to change a position of the preventing portion from the first position to the second position.

According to another aspect of the present invention, there is provided a color electrophotographic image forming apparatus comprising:

a photosensitive member cartridge, detachably mountable to a main assembly of the color electrophotographic image forming apparatus, for holding a photosensitive member;

a plurality of developing cartridges each including a developing roller for developing an electrostatic latent image formed on the photosensitive member into a developer image, the plurality of developing cartridges being demountable from the photosensitive member cartridge;

wherein the developing roller included in each of the plurality of portions opposes a circumferential surface of the photosensitive member having a curvature;

a main assembly-side guide portion, provided in the main assembly, for guiding the photosensitive member cartridge demountably from the main assembly;

a photosensitive member cartridge-side guide portion, provided in the photosensitive member cartridge, for guiding the plurality of developing devices independently demountably from the photosensitive member cartridge;

a demounting portion, provided as a part of the photosensitive member cartridge, being movable between a fifth position in which demounting of the photosensitive member from the photosensitive member cartridge is permitted and a sixth position in which the demounting of the photosensitive member from the photosensitive member cartridge is prevented, wherein the photosensitive member is movable in an axial direction thereof or in a direction in which the photosensitive member is moved away from the developing cartridges.

According to another aspect of the present invention, there is provided a photosensitive member cartridge, detachably mountable to a main assembly of a color electrophotographic image forming apparatus, for holding a photosensitive member, the photosensitive member cartridge comprising:

a portion to be guided by a main assembly-side guide portion, provided in the main assembly, for guiding the photosensitive member cartridge;

a photosensitive member cartridge-side guide portion for guiding a plurality of developing cartridges each including a developing roller for developing an electrostatic latent image formed on the photosensitive member into a developer image, independently demountably from the photosensitive member cartridge;

a preventing portion for preventing movement of the photosensitive member cartridge, wherein when an operation for demounting the developing cartridge is performed in a state in which the photosensitive member cartridge is mounted in the main assembly, the preventing portion is movable between a first position in which the photosensitive member cartridge is prevented from moving in a demounting direction in which the photosensitive member cartridge is to be demounted and a second position in which the photosensitive member cartridge is permitted to move in the demounting direction; and a grip portion for permitting demounting of the photosensitive member cartridge, the grip portion being operable so as to change a position of the preventing portion from the first position to the second position.

According to a further aspect of the present invention, there is provided a photosensitive member cartridge, detachably mountable to a main assembly of a color electrophotographic image forming apparatus, for holding a photosensitive member, the photosensitive member cartridge comprising:

a portion to be guided by a main assembly-side guide portion, provided in the main assembly, for guiding the photosensitive member cartridge;

a photosensitive member cartridge-side guide portion for guiding a plurality of developing cartridges each including a developing roller for developing an electrostatic latent image formed on the photosensitive member into a developer image, independently demountably from the photosensitive member cartridge, wherein the developing roller included in each of the plurality of developing cartridges opposes a circumferential surface of the photosensitive member having curvature;

a demounting portion being movable between a fifth position in which demounting of the photosensitive member from the photosensitive member cartridge is permitted and a sixth position in which the demounting of the photosensitive member from the photosensitive member cartridge is prevented, wherein the photosensitive member is movable in an axial direction thereof or in a direction in which the photosensitive member is moved away from the developing cartridges.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

[Embodiment 1]

(General Structure of a Color Electrophotographic Image Forming Apparatus)

Figure 1A:
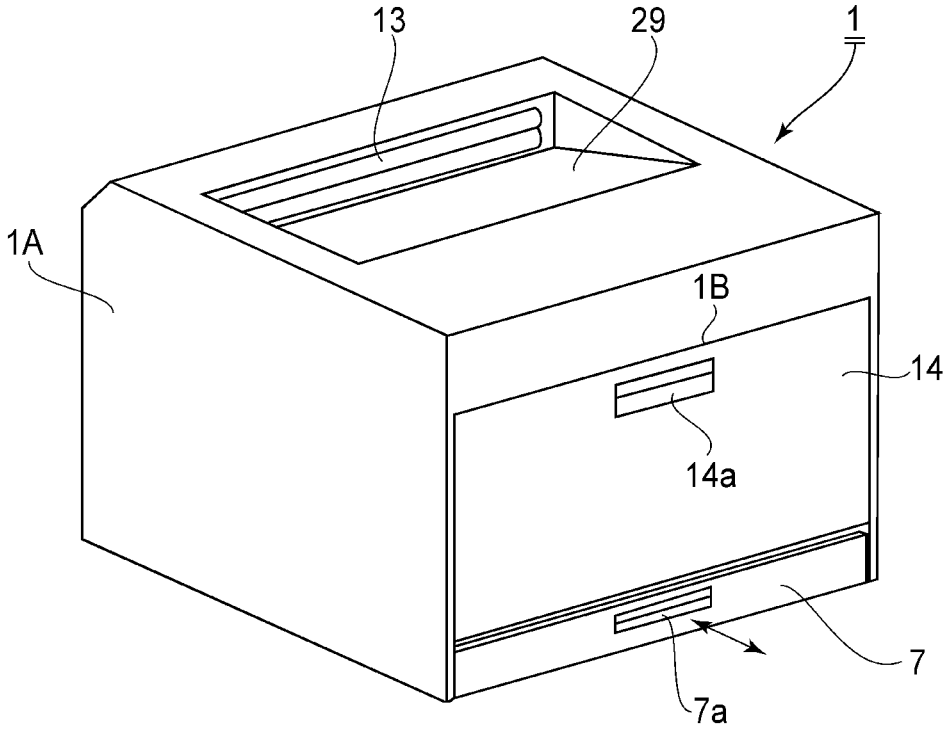
FIG. 1A is a perspective view for an outer appearance of a color electrophotographic image forming apparatus in Embodiment 1.
Figure 1B:
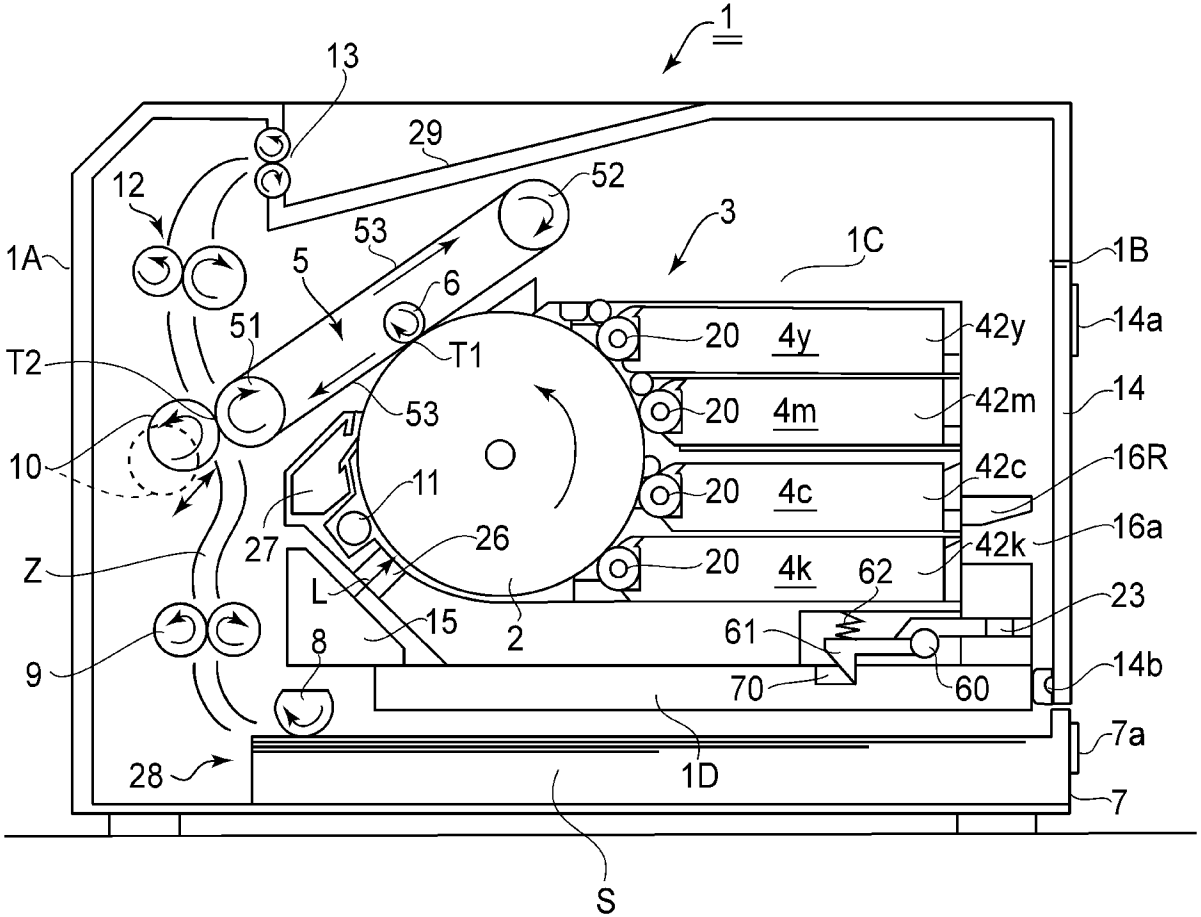
FIG. 1B is a schematic view showing a longitudinal left side surface section of the image forming apparatus.

FIG. 1A is a perspective view of an outer appearance of a color electrophotographic image forming apparatus 1 in this embodiment. FIG. 1B is a schematic view showing a longitudinal left side surface section of the image forming apparatus 1. The image forming apparatus is a four color-based full-color laser printer using an electrophotographic process. That is, the image forming apparatus 1 forms a full-color image on a recording material S on the basis of an electric image signal sent from an external host device (not shown) such as a personal computer, an image reader or a remote facsimile machine to a control circuit portion (not shown). Here, with respect to the image forming apparatus 1, a front side (front surface) means a side (surface) on which a door 14 for covering and uncovering the apparatus. A rear side (rear surface) is a side (surface) opposite from the front side (front surface). A front-rear direction includes a forward direction directed from the rear to the front of the image forming apparatus 1 and includes a rearward direction opposite from the forward direction. A left side (left surface) and a right side (right surface) mean those when the image forming apparatus 1 is viewed from the front side of the image forming apparatus 1. A left-right direction includes a leftward direction directed from the right side to the left side of the image forming apparatus 1 and includes a rightward direction opposite from the leftward direction. A longitudinal direction means an axial direction of a photosensitive member or a developing roller 20. An image forming apparatus main assembly (apparatus main assembly) 1A means an image forming apparatus portion except a photosensitive member cartridge 3 and developing cartridges 4 (4*y*, 4*m*, 4*c*, 4*k*).

At a cartridge mounting portion 1C located at a central portion in the image forming apparatus 1, the cartridge 3 including a drum-shaped photosensitive member (hereinafter referred to as a drum) 2 is mounted demountably from the apparatus main assembly 1A as described later. The drum 2 is rotationally driven, at a predetermined speed in a counter-clockwise direction indicated by an arrow, by a driving mechanism (not shown). Further, at a developing cartridge mounting portion of the cartridge 3, a plurality of developing cartridges 4 each including the developing roller 20 is mounted demountably from the cartridge 3 as described later. In this embodiment, the plurality of developing cartridges 4 is first to fourth (four) cartridges 4*y*, 4*m*, 4*c* and 4*k* which are vertically disposed at four stages on the front side of the drum 2. Yellow (y) toner is accommodated as a developer in a developer accommodating portion 42*y* of the first cartridge 4*y*, and magenta (m) toner is accommodated in a developer accommodating portion 42*m* of the second cartridge 4*m*. Further, cyan (c) toner is accommodated in a developer accommodating portion 42*c* of the third cartridge 4*c*, and black (k) toner is accommodated in a developer accommodating portion 42*k* of the fourth cartridge 4*k*. The cartridge 3 and the developing cartridges 4 will be described more specifically later.

On an upper side of the cartridge 3, a belt unit 5 is disposed. The unit 5 includes a driving roller 51 disposed on a rear side in the apparatus main assembly 1A and a tension roller 52 disposed on a side on which the tension roller 52 is located closer to the front side than the driving roller 51. The unit 5 further includes an endless intermediary transfer belt 53 which is extended and stretched around the two rollers 51 and 52 and is formed of a dielectric material and which has flexibility. Inside the belt 53, a primary transfer roller 6 is disposed. The roller 6 contacts and urges a lower side belt portion of the belt 53 toward the drum 2 with a predetermined urging force. A contact portion between the belt 53 and the drum 2 is a primary transfer nip T1. The belt 53 is circulated and moved in the same direction as the rotational direction of the drum 2 at a speed corresponding to the speed of the drum 2 by driving the roller 51 by a driving mechanism (not shown). At a portion where the belt 53 contacts and is extended around the roller 51, a secondary transfer roller 10 is disposed. The roller 10 is positionally moved, between an operating position in which the roller 10 contacts the belt 53 toward the roller 51 and is indicated by a solid line and a non-operating position in which the roller 10 is separated from the belt 53 and is indicated by a broken line, by a shifting mechanism (not shown). The roller 10 is normally held at the non-operating position and is moved to the operating position with predetermined control timing. In a state in which the roller 10 is moved to the operating position, the cartridge position between the roller 10 and the belt 53 is a secondary transfer nip T2. At a lower portion of the inside of the apparatus main assembly 1Am a sheet feeding unit 28 is disposed. The unit 28 includes a cassette 7 in which a sheet-like recording material S is stacked and accommodated, and includes a pick-up roller 8. The cassette 7 is freely mounted into and demounted from the apparatus main assembly 1 from the front side (front loading). The cassette 7 is provided with a grip 7*a* at its front surface. In the apparatus main assembly 1A, between the cartridge 3 and a rear surface of the apparatus main assembly 1A, a recording material conveying path Z extending from the roller 8 to an upper rear portion in the apparatus main assembly A is provided. Along the conveying path Z, from the lower portion to the upper portion, a conveying roller pair (registration roller pair) 9, the secondary transfer roller 10, a fixing device 12 and a discharge roller pair 13 are disposed. At an upper surface of the apparatus main assembly 1A, a sheet discharge tray 29 on which an image-formed recording material S is to be discharged is disposed.

An operation for forming a full-color image is as follows. On the basis of an image formation start signal, the drum 2 and the belt 53 are rotationally driven. A laser scanner (optical scanner) 15 is also driven. The secondary transfer roller 10 is held at the non-operating position. A predetermined charging bias is applied to a charging roller 11, so that the surface of the drum 2 is uniformly charged to a predetermined polarity and a predetermined potential (charging step). From the scanner 15, laser light L modulated correspondingly to a y-color component image signal for the full-color image is emitted (output), so that the uniformly charged surface of the drum 2 is subjected to scanning exposure (exposure step). As a result, an electrostatic latent image corresponding to the y-color component image is formed on the drum surface. The first developing cartridge 4*y* performs a developing operation with predetermined control timing. That is, the developing roller 20 of the cartridge 4*y* is rotationally driven and a predetermined developing bias is applied to the developing roller 20. As a result, the electrostatic latent image on the drum surface is developed as a y-color toner image (developing step). Then, the y-color toner image is primary-transferred from the surface of the drum 2 onto the belt 53 in the nip T1. To the roller 6, with predetermined control timing, a primary transfer bias of a predetermined potential and of an opposite polarity to a toner charge polarity is applied. The drum surface after the primary transfer is cleaned by a drum cleaner 27 as a cleaning member such as a blade. When the primary transfer of the y-color toner image onto the belt 53 is completed, a step of forming an m-color toner image corresponding to an m-color component image for the full-color image is performed. In this case, the drum 2 is exposed to the laser light L modulated correspondingly to the m-color component image signal and the second cartridge 4*m* performs the developing operation. Then, the m-color toner image is superposedly primary-transferred from the drum 2 onto the belt 53 in a state in which the m-color toner image is positionally aligned with the y-color toner image which has already been transferred onto the belt 53. When the primary transfer of the m-color toner image onto the belt 53 is completed, a step of forming a c-color toner image corresponding to a c-color component image is performed. In this case, the drum 2 is exposed to the laser light L modulated correspondingly to the c-color component image signal and the third cartridge 4*c* performs the developing operation. Then, the c-color toner image is superposedly primary-transferred from the drum 2 onto the belt 53 in a state in which the c-color toner image is positionally aligned with the y-color toner image and the m-color toner image which have already been transferred onto the belt 53. When the primary transfer of the c-color toner image onto the belt 53 is completed, a step of forming a k-color toner image corresponding to a k-color component image is performed. In this case, the drum 2 is exposed to the laser light L modulated correspondingly to the k-color component image signal and the fourth cartridge 4*k* performs the developing operation. Then, the k-color toner image is superposedly primary-transferred from the drum 2 onto the belt 53 in a state in which the k-color toner image is positionally aligned with the y-color toner image, the m-color toner image and the c-color toner image which have already been transferred onto the belt 53.

Thus, on the belt 53, an unfixed full-color toner image based on the toner images of the four colors (y, m, c and k) is synthetically formed. Incidentally, the order of the colors of the toner images successively formed on the drum 2 is not limited to the order of y, m, c and k in this embodiment but may also be appropriately changed. Before a leading end portion of the unfixed (four color-based) full-color toner image transferred on the belt 53 reaches the position of the roller 10 by the movement of the belt 53, the roller 10 is moved to the operating position in which the roller 10 contacts the belt 53. On the other hand, the roller 8 is driven with predetermined control timing. As a result, the recording material S in the cassette 7 is fed one by one. The fed recording material S is introduced into the nip T2 with predetermined control timing by the conveying roller pair 9. To the roller 10, the secondary transfer bias of the predetermined potential and of the opposite polarity to the toner charge polarity is applied. As a result, in a process in which the recording material S is nip-conveyed in the nip T2, the four color toner images superposed on the belt 53 are collectively secondary-transferred onto the surface of the recording material S. The recording material S is separated from the surface of the belt 53 and introduced into the fixing device 12, thus being subjected to application of heat and pressure in a fixing nip. As a result, the respective color toner images are fixed on the recording material S. Then, the recording material S comes out of the fixing device 12 and is discharged on the discharge tray 29 by the discharge roller pair 13 as a full-color image-formed product.

(Photosensitive Member Cartridge)

Figure 2:
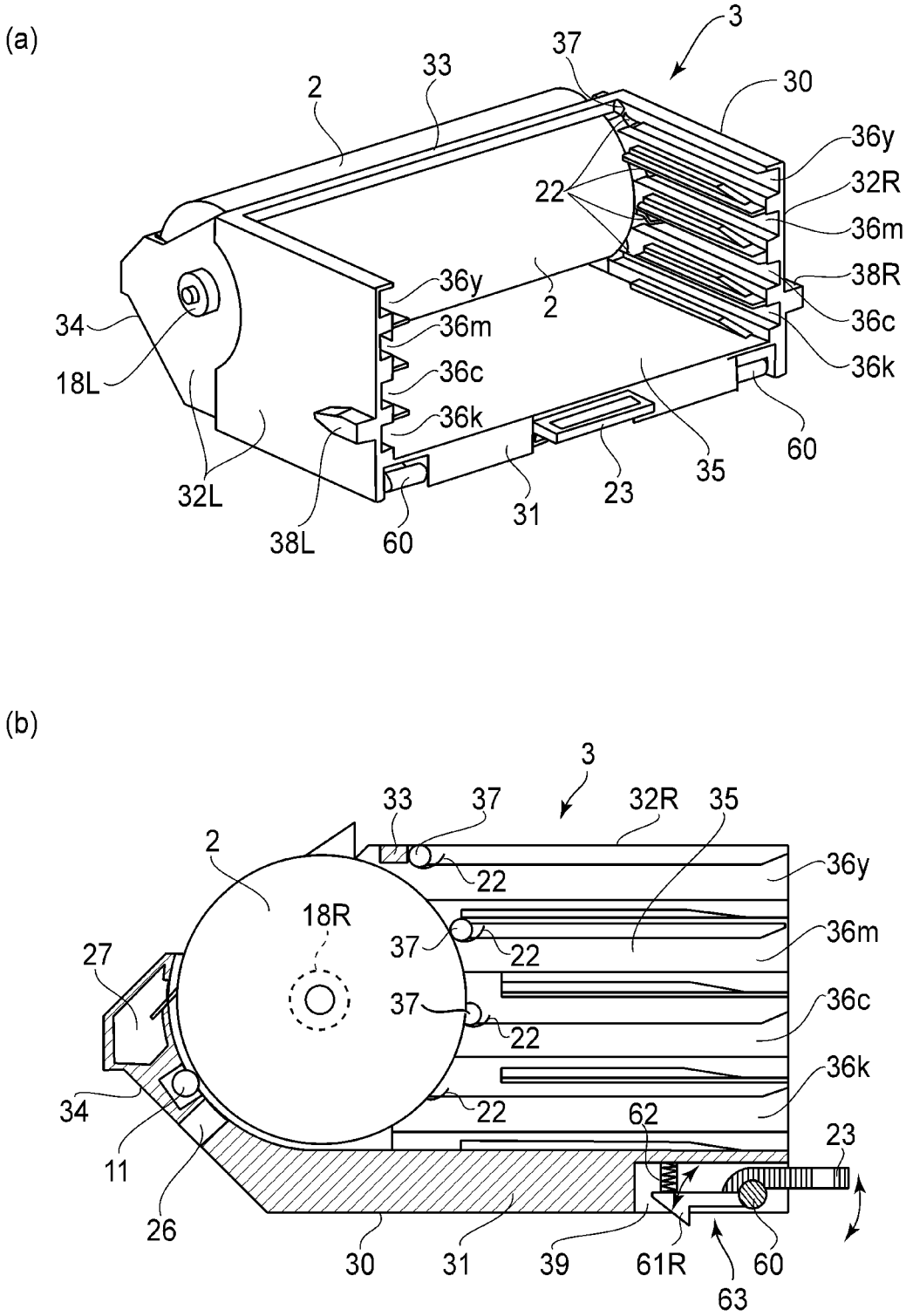
FIG. 2(*a*) is a perspective view of an outer appearance of a photosensitive member cartridge, and FIG. 2(*b*) is a schematic view showing a longitudinal left side surface section of the photosensitive member cartridge.

FIG. 2(*a*) is a perspective view of an outer appearance of the cartridge 3 as seen from the left side surface side, and FIG. 2(*b*) is a longitudinal left side surface view of the cartridge 3. The cartridge 3 includes a frame 30 detachably mountable to the photosensitive member cartridge mounting portion 1C in the apparatus main assembly 1A. The frame 30 includes a bottom plate 31, a left side plate 32L, a right side plate 32R, and a connecting portion 33 for connecting the left and right side plate 32L and 32R. On a rear side of the inside of the frame 30, the drum 2 is rotatably shaft-supported between the left and right side plates 32L and 32R with its axis extending in a left-right direction. A left-side position bearing 18L is provided on an outer surface of the left side plate 32L so as to be projected outwardly from the outer surface. A right-side drum bearing 18R is provided on an outer surface of the right side plate 32R so as to be projected outwardly from the outer surface. In this embodiment, the outwardly projected portion of each of the bearings 18L and 18R is a photosensitive member cartridge-side portion to be positioned. At the rear portion of the bottom plate 31, a rising portion 34 rising along the rear surface of the drum 2 is provided. At the rising portion 34, along the drum rotational direction, three members of the drum cleaner 27, the charging roller 11 and an exposure window portion 26 are disposed. Further, between the side plates 32L and 32R, a frontward space of the drum 2 in the cartridge 3 is used as a developing cartridge mounting portion 35. At the mounting portion 35, inside the left side plate 32L and the right side plate 32R, first to fourth developing cartridge guide portions 36*y*, 36*m*, 36*c* and 36*k* are vertically and bilaterally symmetrically provided at four stages. Each guide portion 36 is a photosensitive member cartridge-side guide portion and is constituted as a groove-type guide extending in a front-rear direction. The left and right guide portions 36 receive left and right end portions of an associated developing cartridge 4 as a portion to be guided and slidably guide the developing cartridge 4 in the front-rear direction. On a rear end side of each guide portion 36, a helical torsion coil spring 22 as a developing cartridge positioning and urging member is provided on a boss 37 in a fitted and held manner. The first to fourth cartridges 4*y*, 4*m*, 4*c* and 4*k* are mounted into and demounted from the first to fourth guide portions 36*y*, 36*m*, 36*c* and 36*k*, respectively. On the other surface sides of the left and right side plates 32L and 32R, left and right projection ribs 38L and 38R as a photosensitive member cartridge-side portion to be guided are provided bilaterally symmetrically so as to extend in the front-rear direction. Further, on the front side of the bottom plate 31, a grip (handle) portion 23 is provided. The grip portion 23 is provided integrally with a shaft 60, at a central portion of the shaft 60, which is rotatably held by a shaft-supporting portion (not shown) provided in an inner space of the bottom plate 31 and extends in the left-right direction. The grip portion 23 is projected frontward from the front surface of the bottom plate 31. At left and right end portions of the shaft 60, left and right downward locking claws 61L and 61R are provided integrally with the shaft 60 with respect to a direction (rearward direction) opposite to a projection direction (frontward direction) as shown in FIGS. 2(*b*) and 3(*a*). The locking claws 61L and 61R are a preventing portion for preventing the movement of the cartridge 3. Each of the locking claws 61L and 61R is movable between a first position and a second position. At the first position, the cartridge 3 is prevented from moving in a demounting direction in which the cartridge 3 is demounted from the apparatus main assembly when a demounting operation of the developing cartridge 4 is performed in a state in which the cartridge 3 is mounted in the apparatus main assembly. At the second position, the cartridge 3 is permitted to move in the demounting direction. By moving the grip portion 23 as described later, the locking claws 61L and 61R can be moved between the first position and the second position.

Each of the locking claws 61L and 61R is rotationally urged about the shaft 60, in the counterclockwise direction indicated by a double-pointed arrow in FIG. 2(*b*), by an urging spring 62 provided between the locking claw and an upper surface of the inner space 39 of the bottom plate 31. Further, in a free state, the downward claw portion of each of the locking claws 61L and 61R is projected downwardly from a lower surface of the bottom plate 31. The grip portion 23, the shaft 60, the locking claws 61L and 61R and the urging springs 62 described above constitute a locking mechanism 63 capable of locking and lock-releasing the cartridge 3 with respect to the apparatus main assembly 1A.

(Developing Cartridge)

Figure 3:
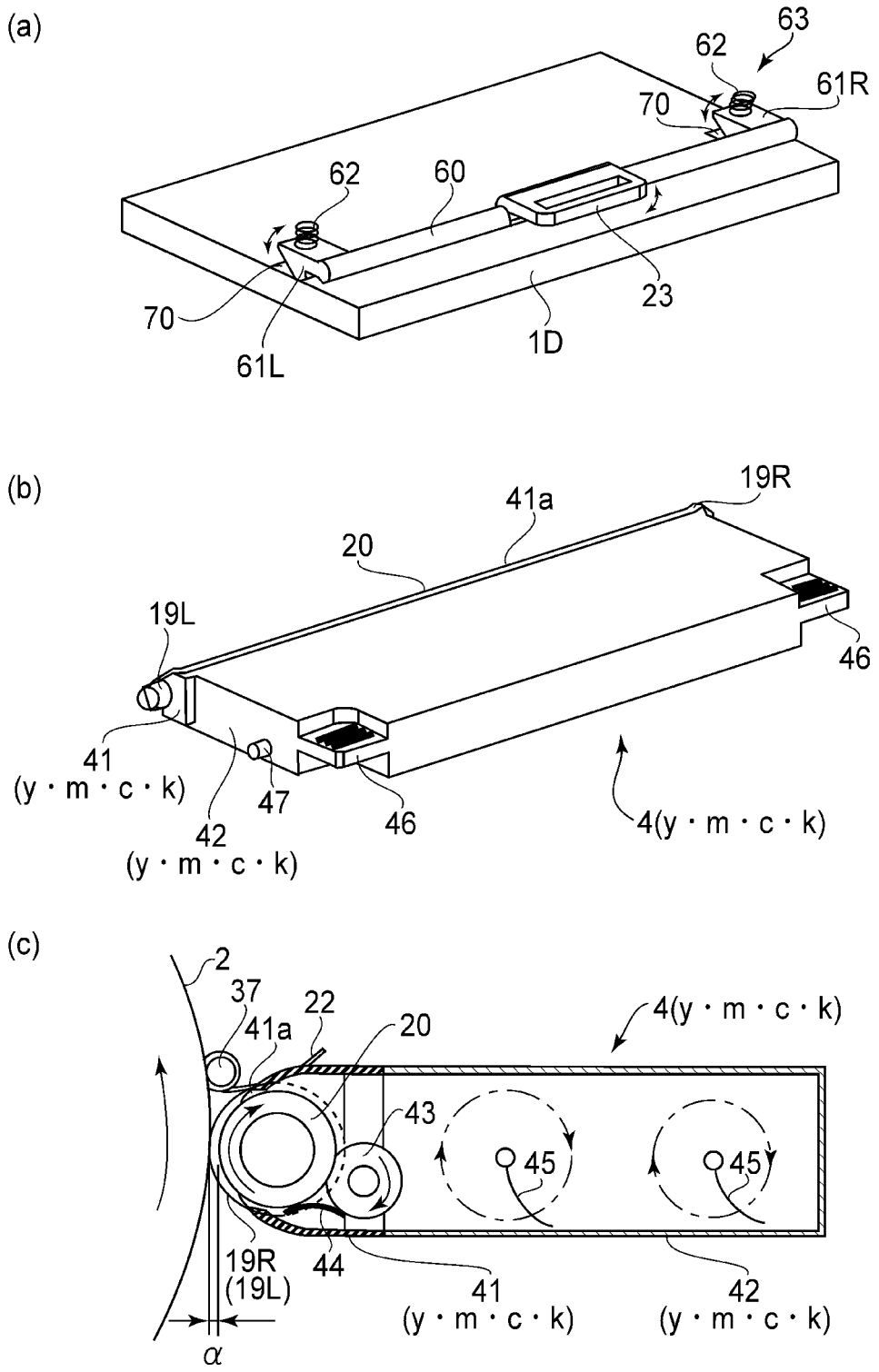
FIG. 3(*a*) is a perspective view of a principal part of a locking mechanism for the photosensitive member cartridge, FIG. 3(*b*) is a perspective view of an outer appearance of a developing cartridge, and FIG. 3(*c*) is an enlarged schematic cross-sectional view of the developing cartridge.

FIG. 3(*b*) is a perspective view of an outer appearance of the developing cartridge 4 as seen from the left side surface side, and FIG. 3(*c*) is an enlarged schematic cross-sectional view of the developing cartridge 4. The developing cartridge 4 (*y.m.c.k*) in this embodiment is a non-contact type developing device using a one component non-magnetic toner as the developer and is integrally connected with a developing device frame 41 (*y.m.c.k*) and a toner frame 42 (*y.m.c.k*). The developing cartridge 4 in this embodiment is an elongated rectangular thin box-like member which is flat as a whole. In the developing device frame 41, the developing roller 20 as a developer carrying member for developing the electrostatic latent image by supplying the toner to the drum 2, an application roller 43 for applying the toner onto the developing roller 20, and a developing blade 44 are incorporated. The toner frame 42 is developer accommodating portion in which the toner is accommodated. Further, in the toner frame 42, a toner stirring and feeding member 45 for feeding the accommodated toner toward the developing device frame 41 side while stirring the accommodated toner is incorporated. The developing device frame 41 is disposed on the rear side of the developing cartridge 4, and the toner frame 42 is disposed on the front side of the developing cartridge 4. The developing roller 20 is rotatably supported between bearings 19L and 19R provided at left and right end portions of the developing device frame 41, and a part of a circumferential surface of the predetermined 20 is exposed through an opening 41*a* provided in the developing device frame 41. An exposed portion of the developing roller 20 opposes the drum 2. The bearings 19L and 19R are outwardly projected from the left and right end portions of the developing device frame 41, respectively, and have an outer diameter set at a predetermined value larger than that of the developing roller 20. Then, in a state in which the developing cartridge 4 is mounted and positioned in the cartridge 3, the bearings 19L and 19R is abutted against and received by left and right end portions of the drum 2, respectively. As a result, as shown in FIG. 3(*c*), a predetermined gap $\alpha$ is created between the drum 2 and the developing roller 20. That is, the left and right bearings 19L and 19R function as a gap regulating member for regulating the gap between the drum 2 and the developing roller 20 at a predetermined value. Further, on each of left and right side surfaces of the toner frame 42, a boss 47 for stopping rotation of the developing cartridge 4 by interfering with the guide portion 36 in the state in which the developing cartridge 4 is mounted and positioned in the cartridge 3 is provided.

(Cartridge Exchange Method)

In an individual developing cartridge 4, with the use for image formation, the toner accommodated in the toner frame 42 is gradually consumed. Then, when the developer (toner) is consumed to such an extent that an image having a satisfactory quality for a user cannot be formed, the developing cartridge 4 loses its commercial value. For this reason, e.g., a means (not shown) for detecting a remaining developer amount of the individual developing cartridge 4 is provided. Then, in a control circuit portion (not shown), the remaining developer amount detected by the means is compared with a threshold preset for advance notice or warning of the end of a lifetime of the developing cartridge 4. With respect to the developing cartridge 4 for which the detected remaining developer amount is less than the threshold, the lifetime-end advance notice or warning is displayed at a display portion of an operating portion (not shown). As a result, the user is urged to prepare a developing cartridge for the exchange or to exchange the developing cartridge 4, so that an output image quality is maintained. Further, also with respect to the photosensitive member cartridge 3, when the integrated number of sheets subjected to the image formation exceeds a predetermined value, the satisfactory quality image for the user is gradually unable to be formed due to a lifetime end of the drum 2 or full of a residual toner containing portion. For this reason, the control circuit portion determines the integrated number of sheets by, e.g., counting the number of rotation of the drum 2 with respect to the mounted cartridge 3 and compares the count with a threshold preset for advance notice or warning of the lifetime end of the cartridge 3. Then, when the integrated number is close to the threshold, the lifetime-end advance notice or warming of the cartridge 3 is displayed at the display portion of the operating portion. As a result, the user is urged to prepare a photosensitive member cartridge for exchange or to exchange the cartridge 3, so that the output image quality is maintained.

Figure 4:
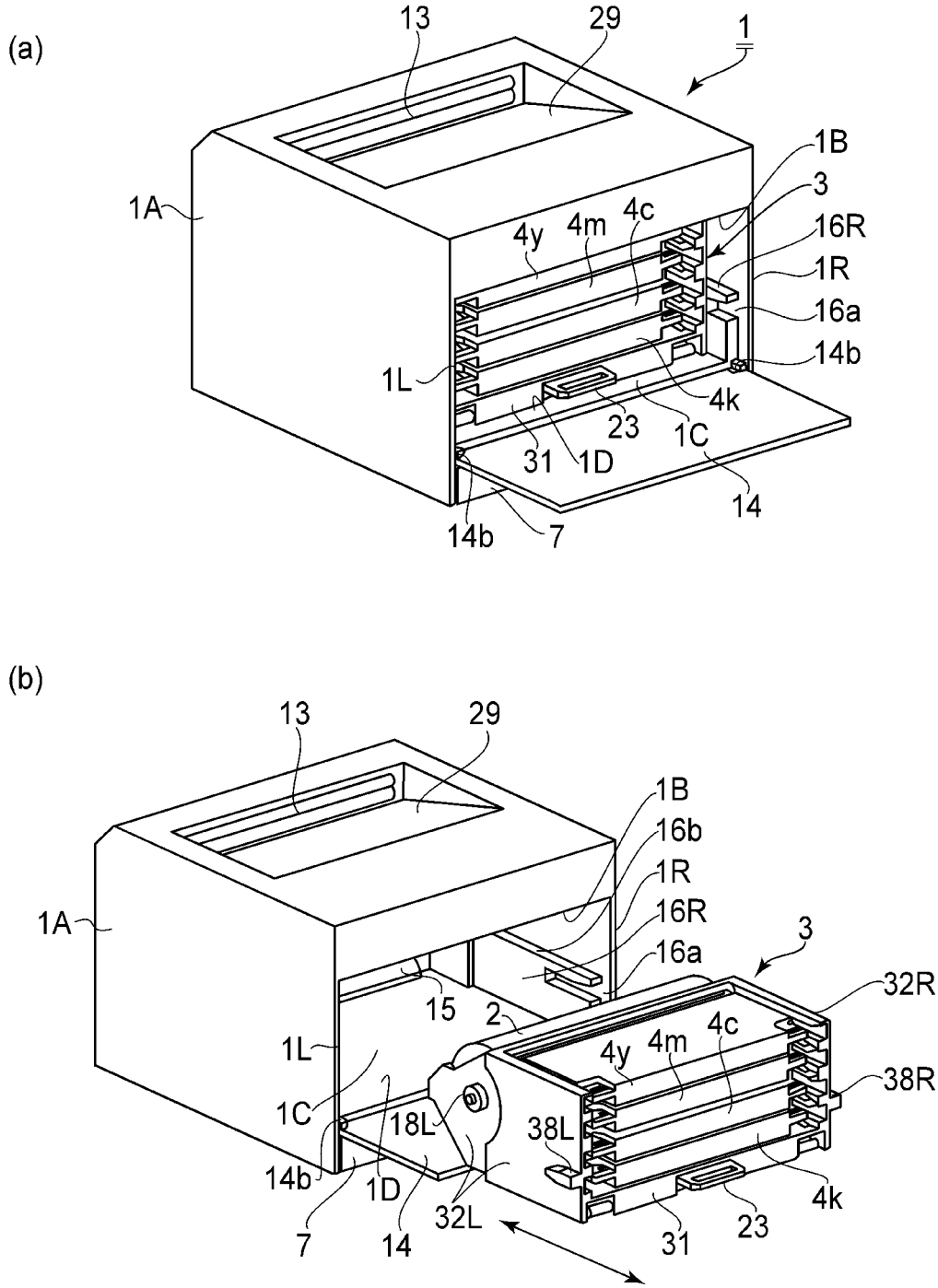
FIG. 4(*a*) is a perspective view of an outer appearance of the image forming apparatus in a state in which a door is opened, and FIG. 4(*b*) is a perspective view of an outer appearance of the image forming apparatus in a state in which the photosensitive member cartridge is, together with developing cartridges, demounted from or mounted into the apparatus main assembly.

In the image forming apparatus in this embodiment, the exchange of the developing cartridge 4 and the cartridge 3 is performed in a front access manner in order to improve usability. That is, on the front surface side of the apparatus main assembly 1A, an opening 1B is provided. The opening 1B permits passing of the developing cartridge 4 and the cartridge 3 in order that the developing cartridge 4 and the cartridge 3 can be mounted into and demounted from the apparatus main assembly 1A. Further, a door (openable member) 14 movable between a closed position in which the opening 1B is covered and an open position in which the opening 1B is uncovered. In this embodiment, the door 14 is rotationally movable about a horizontal shaft (hinge shaft) 14*b*, provided on a lower side of the door 14, so as to cover and uncover the inside of the apparatus main assembly 1A. That is, the door 14 can be rotationally moved about the horizontal shaft 14*b* in a rising direction to be placed in a closed state in which the door 14 covers the inside of the apparatus main assembly 1A as shown in FIGS. 1A and 1B. By closing the door 14, the opening 1B is covered with the door 14. Further, the door 14 is rotationally moved about the horizontal shaft 14*b* in a direction in which the door 14 is opened toward the front side of the apparatus main assembly 1A until the door 14 lies in a substantially horizontal position, so that the door 14 can be placed in an open state in which the opening 1B at the front surface of the apparatus main assembly 1A is sufficiently uncovered as shown in FIG. 4(*a*). The door 14 is provided with a grip portion 14*a*. Thus, through the uncovered opening 1B, a front surface portion of the cartridge 3 mounted at the mounting portion 1C in the apparatus main assembly 1A and a front surface portion of the four developing cartridges 4*y*, 4*m*, 4*c* and 4*k* vertically mounted at the mounting portion 35 in the cartridge 3 are exposed. Then, as shown in FIG. 4(*b*), through the opening 1B, the cartridge 3 is pulled out and moved in the forward direction in a manner described later. As a result, the cartridge 3 can be demounted together with the developing cartridges 4 from the mounting portion 1C in the apparatus main assembly 1A to the outside of the apparatus main assembly 1A. Further, from the mounting portion 35 in the demounted cartridge 3, the developing cartridges 4 can be individually pulled out and demounted. On the other hand, by inserting the cartridge 3 into the apparatus main assembly 1A through the opening 1B and moving the cartridge 3 in the rearward direction, the cartridge 3 can be positioned and mounted at the mounting portion 1C in the apparatus main assembly 1A. Further, as shown in FIG. 4(*a*), the developing cartridges 4 can be individually pulled out from the developing cartridge mounting portion 35 and can be demounted to the outside of the apparatus main assembly 1A through the opening 1B while leaving the cartridge 3 in the mounting state in which the cartridge 3 is mounted at the mounting portion 1C inside the apparatus main assembly 1A. Further, on the other hand, the individual developing cartridge 4 can be mounted into the mounting portion 35 in the cartridge 3 through the opening 1B.

Figure 5:
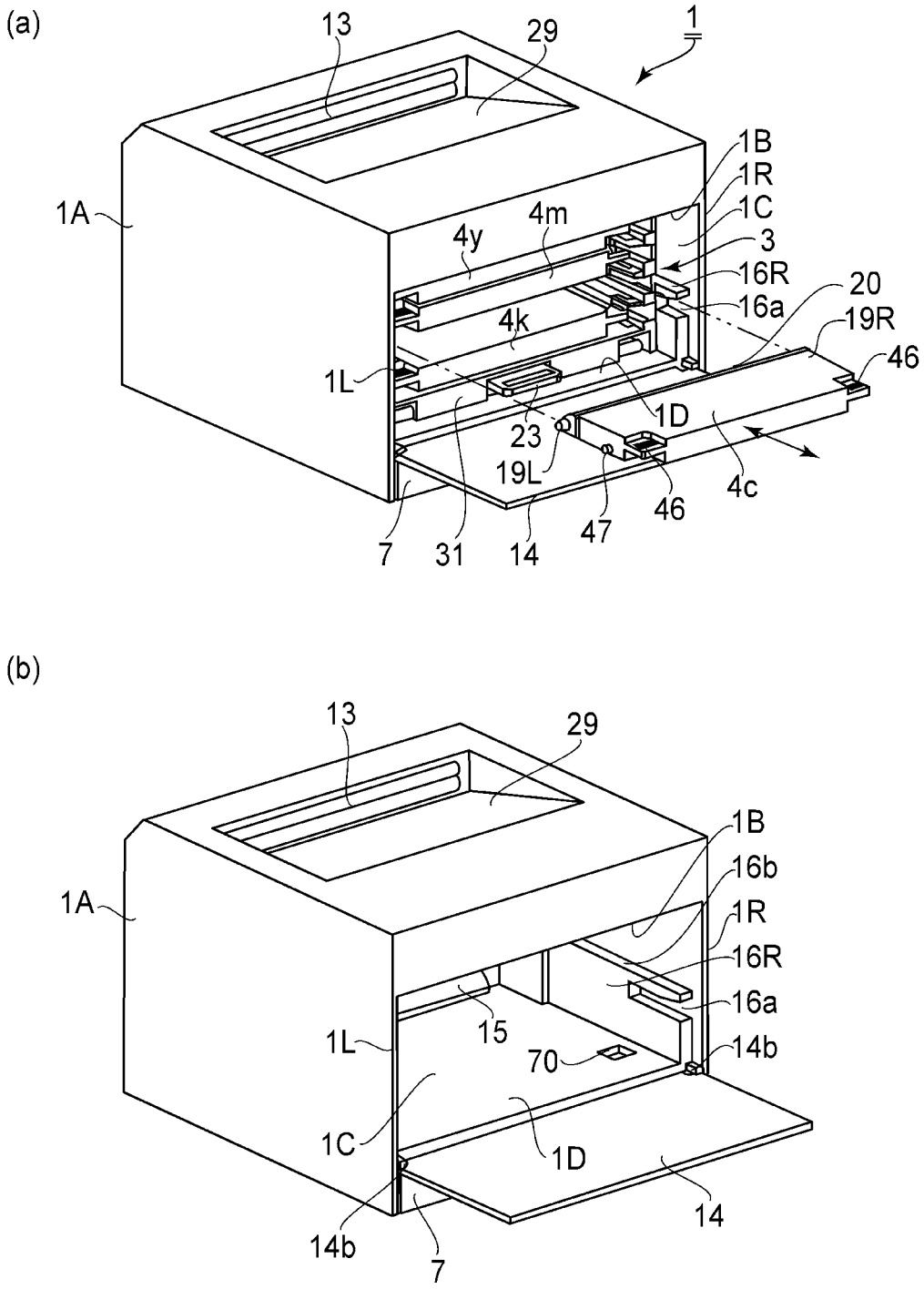
FIG. 5(*a*) is a perspective view of an outer appearance of the image forming apparatus in a state in which the photosensitive member cartridge is mounted in the apparatus main assembly and only one of the developing cartridges is demounted from or mounted into the apparatus main assembly, and FIG. 5(*b*) is a perspective view of an outer appearance of the apparatus main assembly in a state in which the photosensitive member cartridge is demounted as seen from a left side surface side.

In the apparatus main assembly 1A, above the cassette 7, an intermediate bottom plate 1D is provided substantially horizontally. Further, as shown in FIGS. 5(*b*) and 6(*a*), at the mounting portion 1C, inside right and left main assembly side plate portions 1R and 1L, right and left main assembly-side photosensitive member cartridge guides (main assembly-side guide portions) 16R and 16L are provided bilaterally symmetrically. The guides 16R and 16L are used for guiding the cartridge 3 toward the inside and outside of the apparatus main assembly 1A and extend in the front-rear direction. In this embodiment, the intermediate bottom plate 1D and the guides 16R and 16L are constituted as an integral member.

Figure 6:
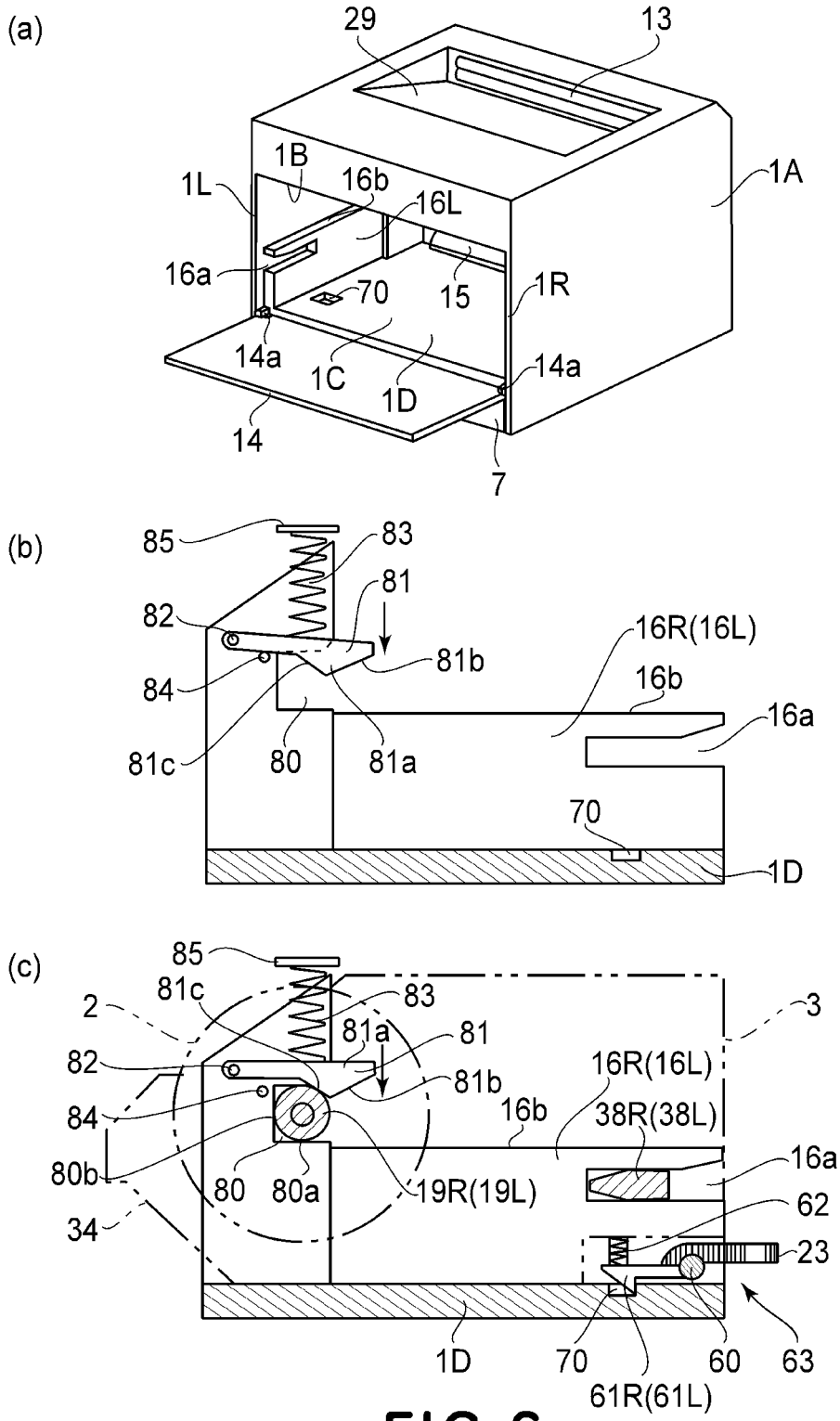
FIG. 6(*a*) is a perspective view of an outer appearance of the image forming apparatus in a state in which the photosensitive member cartridge is demounted as seen from a right side surface side, FIG. 6(*b*) is a schematic view for illustrating a main assembly-side mount cartridge guide and a main assembly-side photosensitive member cartridge positioning portion, and FIG. 6(*c*) is a schematic view for illustrating a positioning state of the photosensitive member cartridge.

The mounting of the cartridge 3 into the apparatus main assembly 1A will be described with reference to FIGS. 5(*b*) and 6(*a*) to 6(*c*). In a state in which the door 14 is opened to uncover the opening 1B as shown in FIGS. 5(*b*) and 6(*a*), the cartridge 3 is inserted into the mounting portion 1C inside the apparatus main assembly 1A through the opening 1B with the drum 2 as a leading portion, so that the bottom plate 31 is placed on the intermediate bottom plate 1D. In this case, at the mounting portion 35 in the cartridge 3, the developing cartridges 4 may be mounted in advance or may be not mounted. When the cartridge 3 is pushed and moved in the rearward direction inside the apparatus main assembly 1A while being slid on the intermediate bottom plate 1D, the outwardly projected portions of the bearings 18L and 18R are placed on and supported by the upper surfaces 16*b* of the guides 16L and 16R. When the cartridge 3 is further pushed into the inside of the apparatus main assembly 1A, the projection ribs 38L and 38R engage in the guide groove portions 16*a*, extending in a front-rear direction, of the guides 16L and 16R, respectively. As a result, the cartridge 3 is guided and inserted further into the inside of the apparatus main assembly 1A. When the cartridge 3 is pushed in further, the outwardly projected portions of the bearings 18L and 18R enter recessed portions 80 (FIG. 6(*b*)), as a main assembly-side photosensitive member opening positioning portion, provided on the rear side of the guides 16L and 16R. Then, the outwardly projected portions of the bearings 18L and 18R are received by a bottom surface 80*a* and rear wall surface 80*b* of the recessed portions 80 (FIG. 6(*c*)). As a result, the cartridge 3 is prevented from further moving in the rearward direction and thus is positioned relative to the apparatus main assembly 1A. Then, the positioned state of the cartridge 3 is kept by an urging force of bearing urging members 81. That is, at positions of the left and right recessed portions 80, the left and right bearing urging members 81 are provided bilaterally symmetrically. The member 81 is vertically swingably and is rotationally urged about a shaft supporting portion 82 in a clockwise direction as shown in FIG. 6(*b*) by an urging force of an urging spring 83 compressedly provided between the upper surface of the member 81 and a fixed (spring) seat 85 provided above the member 81. In a free state, the member 81 is held in a rotational movement angle attitude in which the member 81 is abutted against and stopped by a stopper in 84 as shown in FIG. 6(*b*). Further, the member 81 includes a downward angled portion (V-or L-shaped portion) 81*a* on a lower surface side thereof. In the above-described rotational movement attitude of the member 81, the outwardly projected portions of the bearings 18L and 18R contact an outside inclined surface portion 81*b* of the angled portion 81*a* when the outwardly projected portions enter the positioning recessed portion 80. The outwardly projected portions further enter the recessed portion 80, so that the member 81 is rotationally moved about the shaft supporting portion 81 in a rising direction against the urging force of the spring 83. As a result, each of the outwardly projected portions of the bearings 18L and 18R passes under the downward angled portion 81*a* of the member 81 and enters the predetermined to be stopped by the bottom surface 80*a* and rear wall surface 80*b* of the recessed portion 80, so that the cartridge 3 is positioned relative to the apparatus main assembly 1. Further, an inside inclined surface portion 81*c* of the downward angled portion 81*a* of the member 81 contacts each of the outwardly projected portions of the bearings 18L and 18R. As a result, each of the outwardly projected portions of the bearing 18L and 18R is urged against the bottom surface 80*a* and rear wall surface 80*b* of the recessed portion 80 by the urging force of the spring 83 exerted on the member 81, so that the positioning state of the cartridge 3 relative to the apparatus main assembly 1 is held. That is, the member 81 urges the outwardly projected portions of the bearings 18L and 18R against the recessed portions 80 in the urging direction, so that the cartridge 3 is kept in the positioning state relative to the apparatus main assembly 1A. Further, in the state in which the cartridge 3 is positioned and mounted in the apparatus main assembly 1A, each of the downward claw portions of the locking claws 61L and 61R of the locking mechanism 63 is engaged in the recessed portion 70 provided in the intermediate bottom plate 1D. As a result, the cartridge 3 is held in a state in which the cartridge 3 is locked to be prevented from moving in the forward direction relative to the apparatus main assembly 1A. Here, the locking claws 61L and 61R of the locking mechanism 63 abut against an upper edge of the front surface of the intermediate bottom plate 1D at a leading end-side cam surface of the downward claw portion during the insertion movement of the cartridge 3 relative to the apparatus main assembly 1A. By further insertion movement of the cartridge 3, the locking claws 61L and 61R are inwardly rotated about the shaft 60 against the urging force of the spring 62 to ride on the upper surface of the intermediate bottom plate 1D. The locking claws 61L and 61R move in the rearward direction on the upper surface of the intermediate bottom plate 1D by continuous insertion movement of the cartridge 3 while being kept in the state in which the claws 61L and 61R ride on the upper surface of the plate 1D. Then, in a state in which the cartridge 3 is sufficiently inserted and moved to be positioned and mounted in the apparatus main assembly 1A, the downward claw portion is located correspondingly to the recessed portion 70 of the intermediate bottom plate 1D and the locking claws 61L and 61R engage in the recessed portions 70. That is, the cartridge 3 is held in the state in which the cartridge 3 is locked to be prevented from moving in the forward direction relative to the apparatus main assembly 1A. Further, in the state in which the cartridge 3 is mounted in the apparatus main assembly 1A, the cartridge 3 is mechanically and electrically connected with a driving mechanism (not shown) and an energization mechanism (not shown) on the apparatus main assembly 1A side.

Next, the case where the cartridge 3 mounted in the apparatus main assembly 1A is demounted will be described. The door 14 is opened to uncover the opening 1B. The grip 23 of the cartridge 3 is rotationally moved downwardly against the urging force of the urging spring 62. As a result, the locking of the cartridge 3 in the apparatus main assembly 1A is released, so that the cartridge 3 can be moved in the forward direction in the apparatus main assembly 14. In the lock-released state, the cartridge 3 is moved and pulled out of the apparatus main assembly 1A. the pulling-out movement of the cartridge 3 is guided groove portions 16A. The outwardly projected portions of the bearings 18L and 18R pass under the downward angled portions 81*a* of the members 81 to be escaped forward from the recessed portions 80. Then, the cartridge 3 insufficiently moved in the forward direction to be pulled out of the apparatus main assembly 1A. That is, the cartridge 3 is constituted so as to be demountable from the apparatus main assembly 1A together with the developing cartridge 4 in the state in which the developing cartridges 4*y*, 4*m*, 4*c* and 4*k* are detachably mounted in the cartridge 3.

The mounting and demounting of each developing cartridge 4 from the mounting portion 35 of the cartridge 3 can be performed, as shown in FIG. 5(*a*), in the state in which the cartridge 3 is mounted in the apparatus main assembly 1A. Further, the mounting and demounting of each developing cartridge 4 can also be performed with respect to the cartridge 3 placed in the state in which the cartridge 3 is demounted from the apparatus main assembly 1A. The mounting of the developing cartridge 4 into the mounting portion 35 of the cartridge 3 is performed by inserting the left and right sides of the developing cartridge 4 through a front-side opening of associated left and right side guide portions 36 at the mounting portions 5 with the developing roller 20 side thereof as a leading side. Then, the developing cartridge 4 is moved in the rearward direction and pushed and inserted into the mounting portion 35 along the guide portions 36. When the developing cartridge 4 is sufficiently inserted, the bearings 19L and 19R are abutted against and stopped by the left and right end portions of the drum 2, so that the developing cartridge 4 is positioned relative to the drum 2. That is, the gap a between the drum 2 and the developing roller 20 is regulated at a predetermined value. Further, the bearings 19L and 19R are urged by contact of the helical torsion coil springs 22 with the bearings 19L and 19R. As a result, the above-described positioning state of the developing cartridge 4 relative to the drum 2 is fixed and held. The developing cartridge 4 is positioned by the guide portions 36 with respect to the vertical direction. Further, by the interference of the bosses 47 with the guide portions 36, the rotation of the developing cartridge 4 is stopped. In the state in which the developing cartridge 4 is positioned and fixed relative to the cartridge 3, the developing cartridge 4 is mechanically and electrically connected with a driving mechanism (not shown) and an energization mechanism (not shown) on the cartridge 3 side.

The demounting of the developing cartridge 4 mounted in the cartridge 3 is performed by gripping grips 46, with fingers, provided at left and right portions of the developing cartridge 4 on the front surface side and then by pulling and moving the developing cartridge 4 in the forward direction along the left and right guide portions 36 against the urging force of the springs 22. As a result, the developing cartridge 4 can be mounted from the mounting portion 35 of the cartridge 3 to the outside of the cartridge 3. When only the developing cartridge 4 is pulled out and demounted from the mounting portion 35 in the state in which the cartridge 3 is mounted in the apparatus main assembly 1A, the cartridge 3 is locked in the apparatus main assembly 1A by the locking mechanism 63 to be prevented from moving in the forward direction. For this reason, the cartridge 3 is not pulled out together with the developing cartridge 4. That is, from the cartridge 3 mounted in the apparatus main assembly 1A, the plurality of the developing cartridge 4 can be independently demounted. Further, on the other hand, into the cartridge 3 mounted in the apparatus main assembly 1A, the developing cartridges 4 can be independently mounted.

Figure 7:
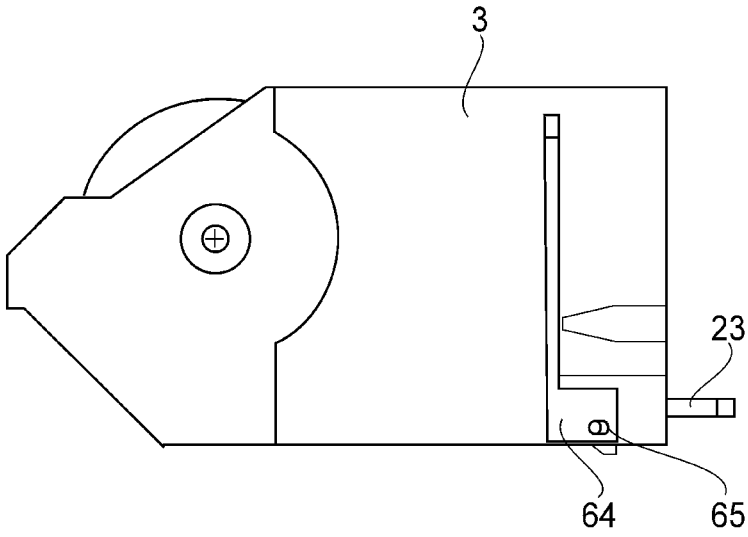
FIG. 7(*a*) is a left side surface view of the photosensitive member cartridge in a mounting state, and FIG. 7(*b*) is a left side surface view of the photosensitive member cartridge in a demounting state.
Figure 7:
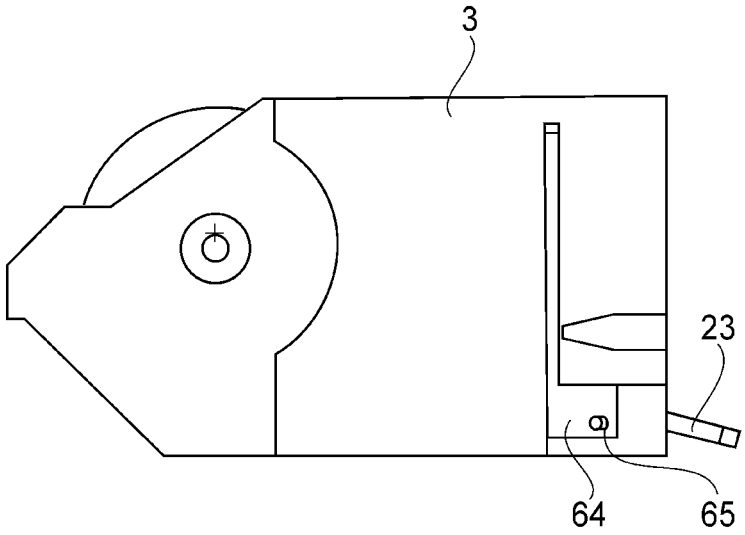
Figure 8:
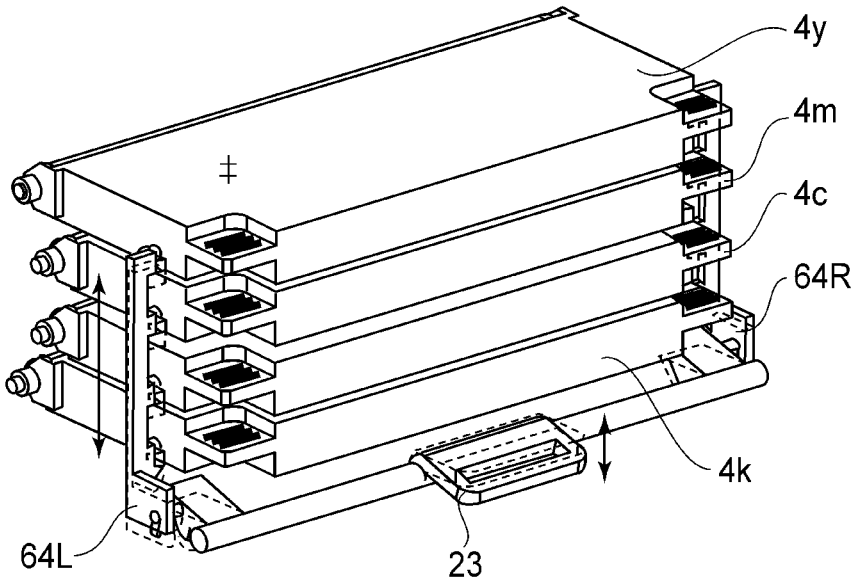
FIG. 8 is a perspective view for illustrating an operating state of a stopper member in a state in which the photosensitive member cartridge is demounted.

Outside the cartridge 3, as shown in FIGS. 7(*a*) and 7(*b*), stopper members 64 interrelated with the operation of the grip 23 are provided. Each of the stopper members 64 is a preventing member for preventing the demounting of the cartridge 3. Each of the stopper members 64 is movable between a third position in which the demounting of the developing cartridge 4 from the cartridge 3 is prevented and a fourth position in which the demounting of the developing cartridge 4 from the cartridge 3 is permitted. In FIG. 8, a position indicated by a broken line is a stand-by position (fourth position) in which the demounting of the developing cartridge 4 from the cartridge 3 is permitted, and a position indicated by a solid line is a preventing position (third position) in which the demounting of the developing cartridge 4 from the cartridge 3 is prevented. When the cartridge 3 is demounted, the user operates the grip 23 to place the locking claws 61L and 61R in a lock-released position (second position). When the locking claws 61 are moved from a preventing position (first position) to the lock-released position (second position), the stopper members 64 are moved from the stand-by position to the preventing position by the bosses 65 provided at the end portions of the locking claws 61.

That is, when the locking claws 61 are located at the lock-released position (second position), the stopper members 64 are located at the preventing position (third position). Further, when the locking claws 61 are located at the preventing position (first position), the stopper members 64 are located at the stand-by position (fourth position).

In the case where the cartridge 3 is moved swiftly when the cartridge 3 is mounted or demounted, there is a possibility that the developing cartridges 4 come out of the cartridge 3 by the swift movement. However, in the constitution in this embodiment, it is possible to prevent the developing cartridges 4 from coming out of the cartridge 3 by the stopper members 64.

As described above, relative to the cartridge 3, the drums 2 and the developing rollers 20 are positioned by the same part 30. Further, as described in this embodiment, the four developing cartridges 4*y*, 4*m*, 4*c* and 4*k* are positioned. As a result, a complicated exchange operation such that the cartridge 3 is demounted after the four developing cartridges 4 are demounted when the cartridge 3 is exchanged can be avoided, so that alignment of the cartridge 3 with the four developing cartridges 4 can be ensured.

Incidentally, in Embodiment 1, the cylindrical drum is described as the photosensitive member. However, the present invention is not limited thereto but may also employ a photosensitive belt.

[Embodiment 2]

Figure 9:
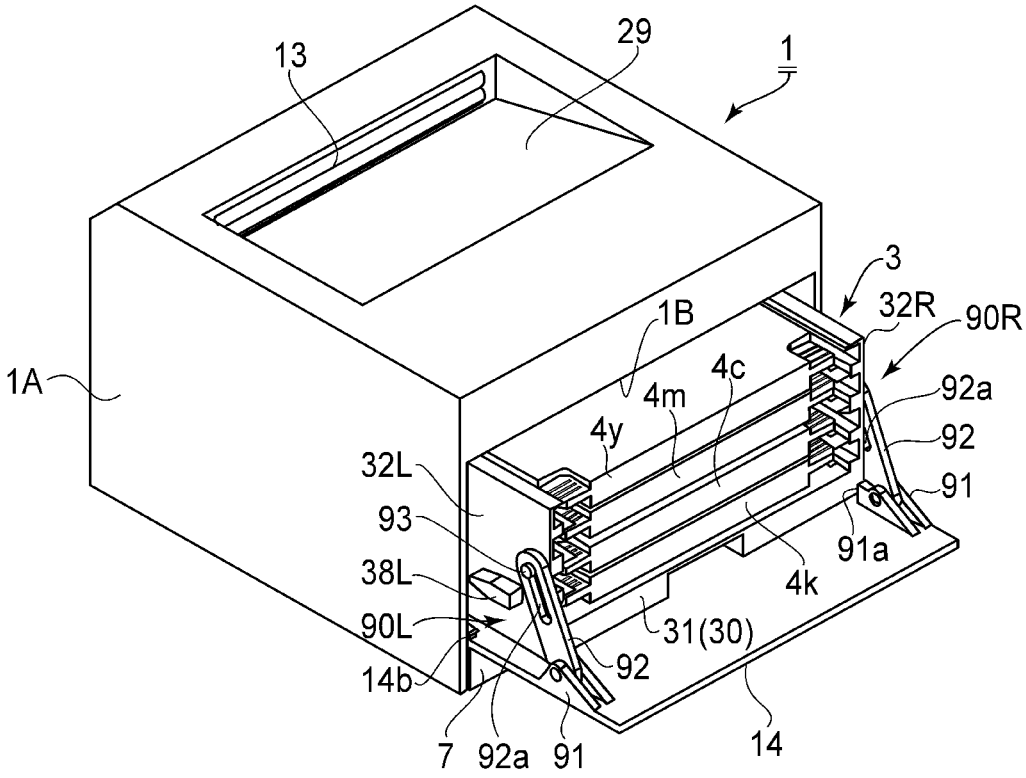
FIG. 9 is a schematic illustration of a color electrophotographic image forming apparatus in Embodiment 2.

An image forming apparatus in this embodiment will be described with reference to FIG. 9. In this embodiment, constituent members or portions common to those in Embodiments 1 and 2 are represented by the same reference numerals or symbols, thus being omitted from redundant description. Also in the image forming apparatus 1 in this embodiment, similarly as in the image forming apparatus 1 in Embodiment 1, the cartridge 3 is positioned relative to the apparatus main assembly 1A and the developing cartridges 4*d* (4*y*, 4*m*, 4*c* and 4*k*) are positioned relative to the cartridge 3. Further, these cartridges 3 and 4 are integrally mountable and demountable. In the image forming apparatus 1 in this embodiment, the cartridge 3 and the door 14 are connected by left and right link mechanisms 90L and 90R partly move outwardly the cartridge 3, through the opening 1B, placed in the positioning state in the apparatus main assembly 1A in interrelation with the opening operation of the door 14, so that the front-side portion of the cartridge 3 is exposed as shown in FIG. 9. On the other hand, in interrelation with the closing operation of the door 14, the link mechanisms 90L and 90R partly move inwardly the cartridge 3, through the opening 1B, partly exposed from the apparatus main assembly 1A, so that the cartridge 3 is returned to the positioning state in the apparatus main assembly 1A. That is, each of the link mechanisms 90L and 90R is provided with the hinge 91 on the door 14 side. To the hinge 91, a link 92 is rotatably attached. Further, on the cartridge 3 side, a link boss 93 is provided in a slit portion 92*a* of the link 92. Therefore, when the cartridge 3 and the developing cartridges 4 are mounted or demounted, by opening the door 14, the cartridge 3 is partly pulled out outwardly (forward) through the opening 1B to a position in which exchange of a desired developing cartridge 4 can be performed easily. As a result, the user can perform the mounting and demounting operation of the developing cartridge 4 with respect to the cartridge 3 without putting his (her) hands into the inner rear portion of the apparatus main assembly 1A. Further, the hinge 91 is provided with a stopper portion 91*a*. When the developing cartridge 4 is pulled out of the photosensitive member cartridge 3, the stopper portions 91*a* hold the photosensitive member cartridge 3. For this reason, the developing cartridge 4 and the photosensitive member cartridge 3 are configured so that they cannot pulled out simultaneously. That is, the plurality of developing cartridges 4*y*, 4*m*, 4*c* and 4*k* are independently demountable from and mountable into the cartridge 3. When the cartridge 3 is exchanged, the cartridge 3 is demounted from and mounted into the apparatus main assembly 1A by detaching the links 92 and the stopper portions 91*a*. In this case, the cartridge 3 can be demounted and mounted alone or together with the developing cartridges 4. Also in this embodiment, an effect similar to that in Embodiment 1 is achieved, so that the improvement in operativity of the cartridge 3 and the alignment between the cartridge 3 and the developing cartridges 4 can be ensured. By interrelating the partial pulling-out operation of the cartridge 3 with the operation of the door 14, it is also possible to improve the mounting and demounting operation of the developing cartridges 4.

Further, a demounting constitution of the drum 2 which is a feature of this embodiment will be described. The photosensitive member has the drum shape and each developing cartridge 4 is disposed to oppose the circumferential surface of the drum 2 having curvature (FIG. 2(*b*)). The case where only the drum 2 is demounted without demounting the developing cartridges 4 after the cartridge 3 is demounted from the apparatus main assembly 1A will be considered. When the drum 2 is intended to be demounted in the upward direction in FIG. 2(*b*), the developing cartridges 4 are present in the movement direction of the drum 2, so that the drum 2 and the developing cartridges 4 interfere with each other. As a result, the drum 2 cannot be demounted. In this embodiment, a demounting portion for permitting the demounting of the drum 2 so that the drum 2 can be moved in a direction in which the drum 2 is moved away from the developing cartridges 4 when the drum 2 is demounted from the photosensitive member cartridge 3 is provided.

Figure 10:
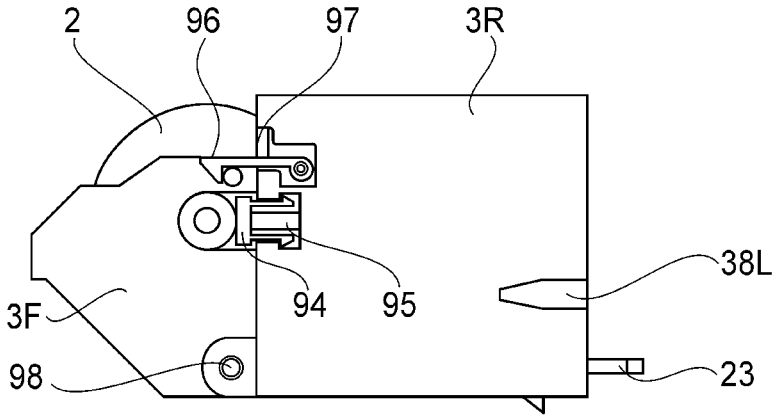
FIG. 10(*a*) is a schematic view for illustrating a structure of a photosensitive member cartridge in Embodiment 2, and FIG. 10(*b*) is a schematic view for illustrating a mounting and demounting method of a drum.
Figure 10:
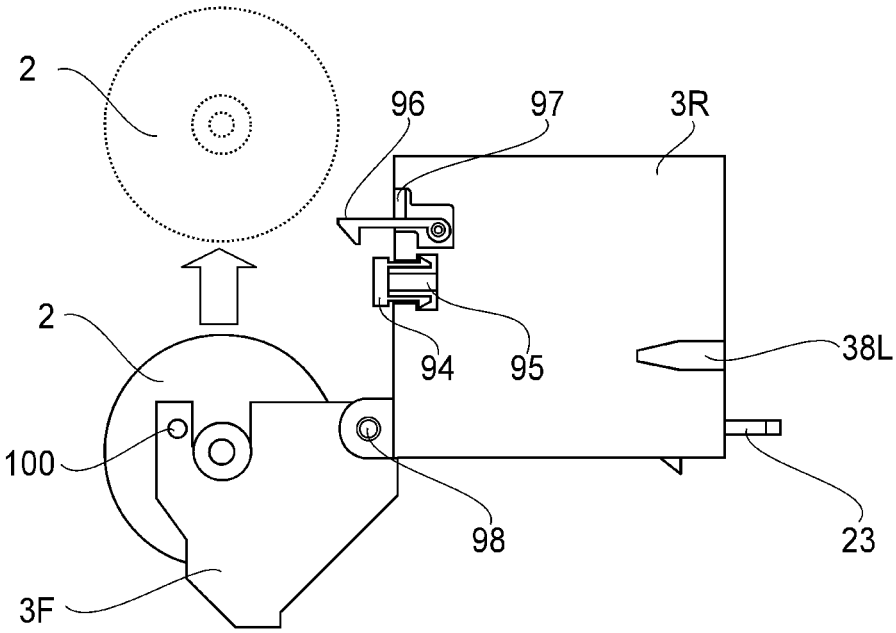

FIGS. 10(*a*) and 10(*b*) show a constitution of the demounting of the drum 2. The cartridge 3 is constituted by two portions consisting of a drum holding portion (demounting portion) 3F and a developing cartridge holding portion 3R. FIG. 10(*a*) shows a state in which the drum holding portion 3F is located at a drum demountable position (fifth position), and FIG. 10(*b*) shows a state in which the drum holding portion 3F is located at a drum demounting-preventing position (sixth position). When the drum holding portion 3F is located at the drum demounting-preventing position, image formation can be effected. The drum holding portion 3F is rotatably provided on the developing cartridge holding portion 3R by a rotatable portion 98. The drum holding portion 3F is held at the drum demounting-preventing position by a drum locking claw 96 urged by an urging spring 97 and a boss 100 provided on the drum holding portion 3F. The drum 2 is positioned by urging its shaft with a drum urging member 94. The drum urging member 94 is provided on the developing cartridge holding portion 3R and urges the drum 2 in the positioning direction by a drum urging spring 95.

By releasing engagement between the drum locking claw 96 and the boss 100, the drum holding portion 3F can be exposed and rotationally moved about the boss 100 to the drum demounting position as shown in FIG. 10(*b*). In the state shown in FIG. 10(*b*), the drum 2 can be exchanged alone. When the drum holding portion 3F is moved from the drum demounting-preventing position to the drum demountable position, the drum 2 is moved in the direction in which the drum 2 is moved away from the developing cartridges 4. That is, the drum holding portion 3F is configured so that the drum 2 can be moved in the direction in which the drum 2 is moved away from the developing cartridges 4 when the drum 2 is demounted from the cartridge 3. As a result, it is possible to avoid such a phenomenon that the drum 2 interferes with the developing cartridges 4 and the demounting of the drum 2 is obstructed.

Figure 11:
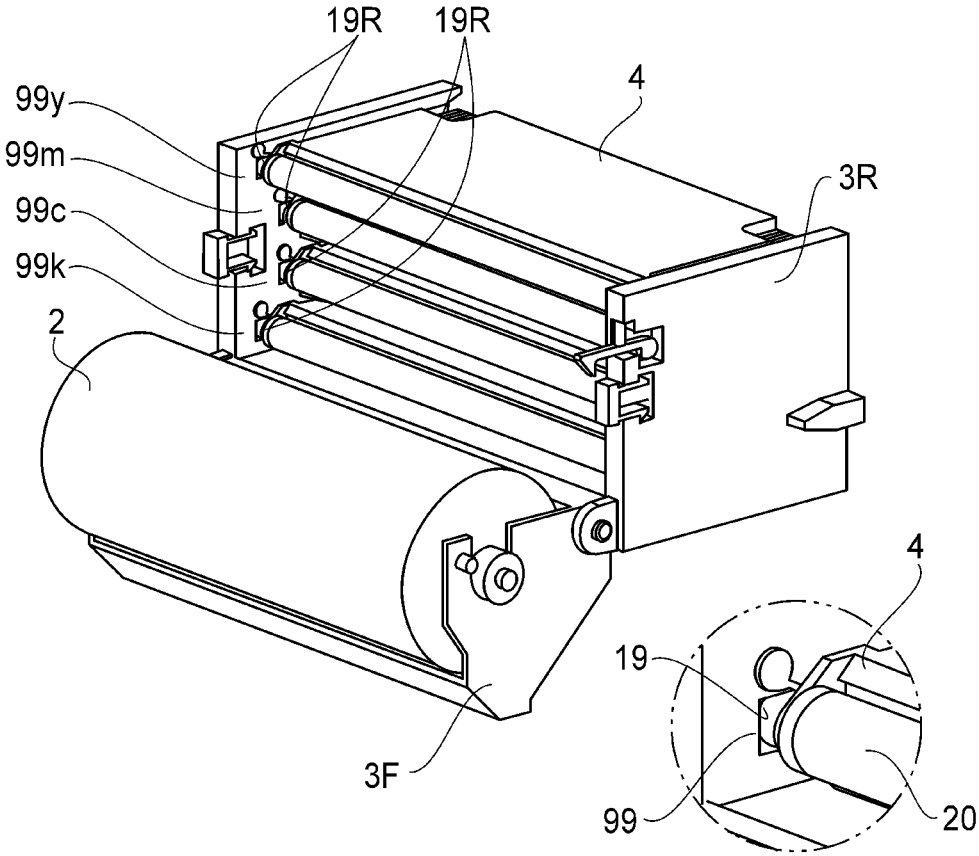
FIG. 11 is a perspective view for illustrating a developing cartridge preventing portion.

Further, as shown in FIG. 11, the developing cartridge holding portion 3R includes developing cartridge movement-preventing portions 99*y*, 99*m*, 99*c* and 99*k* (hereinafter referred to as preventing portions 99) for preventing the developing cartridges 4 from moving in the drum direction. Even when the drum holding portion 3F is exposed and the drum 2 is moved away from the developing cartridges 4, the developing cartridges 4 are still prevented from moving by the preventing portions 99. For that reason, it is possible to prevent the developing cartridges 4 from being moved accidentally toward the drum 2.

Figure 12:
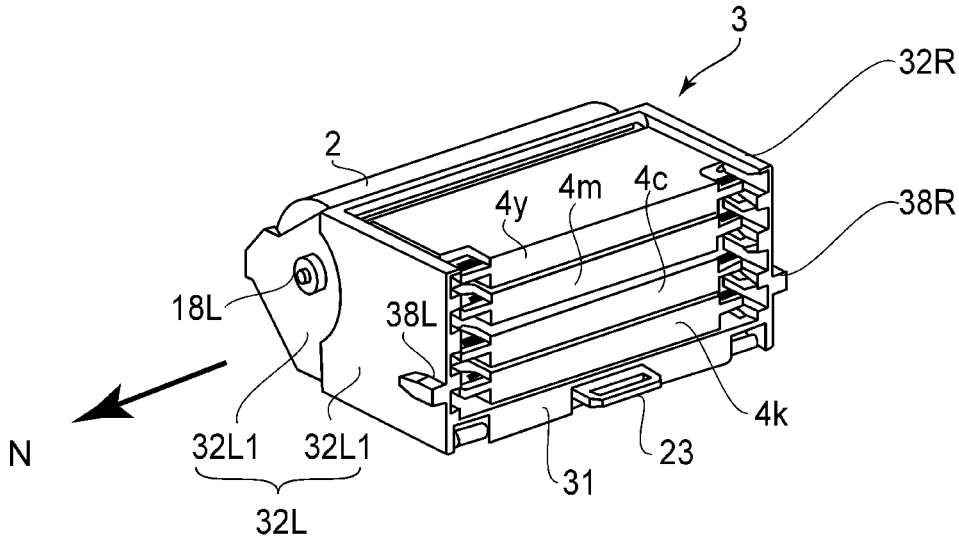
FIG. 12 is a perspective view for illustrating another mounting and demounting method of the drum.

Incidentally, in the constitution shown in FIGS. 10(*a*) and 10(*b*), the drum holding portion 3F is movably provided but the present invention is not limited thereto. For example, the drum 2 may also be moved away from the developing cartridges 4 when a door member which is not the drum holding portion is openably provided and is located at the drum demountable position. Further, in order to demount the drum 2, it is also possible to employ such a constitution that the drum 2 can be pulled out in the axial direction of the drum 2 as shown in FIG. 12. Referring to FIG. 12, the left side plate 32L of the cartridge 3 includes an openable portion 32L1 from which the drum 2 is demountable and includes a portion 32L2 for supporting the developing cartridges 4*y*, 4*m*, 4*c* and 4*k*. When the openable portion 32L1 is moved to a position (fifth position) in which the drum 2 can be demounted in the axial direction of the drum 2, the drum 2 can be pulled out in the direction indicated by an arrow N.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 177667/2009 filed Jul. 30, 2009 and 147533/2010 filed Jun. 29, 2010, which is hereby incorporated by reference.

What is claimed is:

1. A color electrophotographic image forming apparatus comprising:

a photosensitive member cartridge, detachably mountable to a main assembly of said color electrophotographic image forming apparatus, for holding a photosensitive member;

a plurality of developing cartridges each including a developing roller for developing an electrostatic latent image formed on said photosensitive member into a developer image, said plurality of developing cartridges being demountable from said photosensitive member cartridge;

a main assembly-side guide portion, provided in the main assembly, for guiding said photosensitive member cartridge demountably from the main assembly;

a photosensitive member cartridge-side guide portion, provided in said photosensitive member cartridge, for guiding said plurality of developing cartridges independently demountably from said photosensitive member cartridge;

a preventing portion, provided in said photosensitive member cartridge, for preventing movement of said photosensitive member cartridge, and a grip portion for permitting demounting of said photosensitive member cartridge, said grip portion being operable so as to change a position of said preventing portion from a first position to a second position, wherein, when an operation for demounting said developing cartridges is performed in a state in which said photosensitive member cartridge is mounted in the main assembly, said preventing portion is movable between the first position in which said photosensitive member cartridge is prevented from moving in a demounting direction in which said photosensitive member cartridge is to be demounted and the second position in which said photosensitive member cartridge is permitted to move in the demounting direction.

2. An apparatus according to claim 1, further comprising a preventing member capable of movable between a third position in which demounting of said developing cartridges from said photosensitive member cartridge is prevented and a fourth position in which the demounting of said developing cartridges from said photosensitive member cartridge is permitted, wherein said preventing member is located at the third position when said preventing portion is located at the second position and is located at the fourth position when said preventing portion is located at the first position.

3. A color electrophotographic image forming apparatus comprising:

a photosensitive member cartridge, detachably mountable to a main assembly of said color electrophotographic image forming apparatus, for holding a photosensitive member;

a plurality of developing cartridges each including a developing roller for developing an electrostatic latent image formed on said photosensitive member into a developer image, said plurality of developing cartridges being demountable from said photosensitive member cartridge;

a main assembly-side guide portion, provided in the main assembly, for guiding said photosensitive member cartridge demountably from the main assembly;

a photosensitive member cartridge-side guide portion, provided in said photosensitive member cartridge, for guiding said plurality of developing cartridges independently demountably from said photosensitive member cartridge; and a demounting portion, provided as a part of said photosensitive member cartridge, being movable between a first position in which demounting of said photosensitive member from said photosensitive member cartridge is permitted and a second position in which the demounting of said photosensitive member from said photosensitive member cartridge is prevented, wherein, when said photosensitive member cartridge is demounted from said main assembly of said color electrophotographic image forming apparatus and demounting portion is located at the first position, said photosensitive member is demountable from said photosensitive member cartridge.

4. An apparatus according to claim 3, wherein said photosensitive member cartridge comprises a movement preventing portion for preventing said developing cartridges from moving toward said photosensitive member when said demounting portion is located at the first position.

5. An apparatus according to claim 3, further comprising preventing portion, provided in said photosensitive member cartridge, for preventing movement of said photosensitive member cartridge; and a grip portion for permitting demounting of said photosensitive member cartridge, wherein, when an operation for demounting said developing cartridges is performed in a state in which said photosensitive member cartridge is mounted in the main assembly, said preventing portion is movable between a first position in which said photosensitive member cartridge is prevented from moving in a demounting direction in which said photosensitive member cartridge is to be demounted and a second position in which said photosensitive member cartridge is permitted to move in the demounting direction, and wherein said grip portion is operable so as to change a position of said preventing portion from the first position to the second position.

6. An apparatus according to claim 3, further comprising an openable door provided on the main assembly and comprising a link mechanism, provided between said door and said photosensitive member cartridge, for pulling out said photosensitive member cartridge from the main assembly in interrelation with an opening operation of said door.

7. A photosensitive member cartridge, detachably mountable to a main assembly of a color electrophotographic image forming apparatus, for holding a photosensitive member, said photosensitive member cartridge comprising:

a portion to be guided by a main assembly side guide portion, provided in the main assembly, for guiding said photosensitive member cartridge;

a photosensitive member cartridge-side guide portion for guiding a plurality of developing cartridges each including a developing roller for developing an electrostatic latent image formed on said photosensitive member into a developer image, independently demountably from said photosensitive member cartridge;

a preventing portion for preventing movement of said photosensitive member cartridge; and a grip portion for permitting demounting of said photosensitive member cartridge, said grip portion being operable so as to change a position of said preventing portion from a first position to a second position, wherein, when an operation for demounting said developing cartridges is performed in a state in which said photosensitive member cartridge is mounted in the main assembly, said preventing portion is movable between the first position in which said photosensitive member cartridge is prevented from moving in a demounting direction in which said photosensitive member cartridge is to be demounted and the second position in which said photosensitive member cartridge is permitted to move in the demounting direction.

8. A cartridge according to claim 7, further comprising a preventing member capable of movable between a third position in which demounting of said developing cartridges from said photosensitive member cartridge is prevented and a fourth position in which the demounting of said developing cartridges from said photosensitive member cartridge is permitted, and wherein said preventing member is located at the third position when said preventing portion is located at the second position and is located at the fourth position when said preventing portion is located at the first position.

9. A photosensitive member cartridge, detachably mountable to a main assembly of a color electrophotographic image forming apparatus, for holding a photosensitive member, said photosensitive member cartridge comprising:

a portion to be guided by a main assembly-side guide portion, provided in the main assembly, for guiding said photosensitive member cartridge;

a photosensitive member cartridge-side guide portion for guiding a plurality of developing cartridges each including a developing roller for developing an electrostatic latent image formed on the photosensitive member into a developer image, independently demountably from said photosensitive member cartridge; and a demounting portion being movable between a first position in which demounting of said photosensitive member from said photosensitive member cartridge is permitted and a second position in which the demounting of said photosensitive member from said photosensitive member cartridge is prevented, wherein, when said photosensitive member cartridge is demounted from the main assembly and said demounting portion is located at the first position, said photosensitive member is demountable from said photosensitive member cartridge.

10. A cartridge according to claim 9, further comprising a movement preventing portion for preventing said developing cartridges from moving toward said photosensitive member when said demounting portion is located at the first position.

11. A cartridge according to claim 9, further comprising preventing portion for preventing movement of said photosensitive member cartridge; and a grip portion for permitting demounting of said photosensitive member cartridge, wherein, when an operation for demounting said developing cartridges is performed in a state in which said photosensitive member cartridge is mounted in the main assembly, said preventing portion is movable between a first position in which said photosensitive member cartridge is prevented from moving in a demounting direction in which said photosensitive member cartridge is to be demounted and a second position in which said photosensitive member cartridge is permitted to move in the demounting direction, and wherein said grip portion is operable so as to change a position of said preventing portion from the first position to the second position.

12. An apparatus according to claim 3, wherein, when said photosensitive member is demounted from said photosensitive member cartridge, said photosensitive member is movable in an axial direction thereof or in a direction in which said photosensitive member is moved away from said developing cartridges.

13. An apparatus according to claim 3, wherein said photosensitive member is demountable from said photosensitive member cartridge while mounting said plurality of developing cartridges to said photosensitive member cartridge.

14. An apparatus according to claim 3, wherein said developing roller opposes a peripheral surface of said photosensitive member having curvature.

15. A cartridge according to claim 9, wherein, when said photosensitive member is demounted from said photosensitive member cartridge, said photosensitive member is movable in an axial direction thereof or in a direction in which said photosensitive member is moved away from said developing cartridges.

16. A cartridge according to claim 9, wherein said photosensitive member is demountable from said photosensitive member cartridge while mounting said plurality of developing cartridges to said photosensitive member cartridge.

17. A cartridge according to claim 9, wherein said developing roller opposes a peripheral surface of said photosensitive member having curvature.

* * * * *